United States Patent [19]

Schultz

[11] 4,078,359

[45] Mar. 14, 1978

[54] METHOD OF MAKING A PRESSURE-OPERATED CONTAINER FOR VISCOUS PRODUCTS

[76] Inventor: Robert S. Schultz, 7 Heusted Dr., Old Greenwich, Conn. 06870

[21] Appl. No.: 760,462

[22] Filed: Jan. 18, 1977

Related U.S. Application Data

[60] Division of Ser. No. 616,363, Sep. 24, 1975, which is a continuation-in-part of Ser. No. 459,328, Apr. 9, 1974, abandoned.

[51] Int. Cl.[2] ..... B65B 31/00
[52] U.S. Cl. ..... 53/36; 53/43
[58] Field of Search ..... 53/22 R, 36, 43; 222/389

[56] References Cited

U.S. PATENT DOCUMENTS

| | | | |
|---|---|---|---|
| 3,022,923 | 2/1962 | Hoffman | 222/389 X |
| 3,981,119 | 9/1976 | Schultz | 53/36 X |

*Primary Examiner*—Travis S. McGehee
*Attorney, Agent, or Firm*—Hopgood, Calimafde, Kalil, Blaustein & Lieberman

[57] ABSTRACT

The invention contemplates a method of product-loading a pressure-operated dispensing container upon the head end of a selected piston whereby the weight of loaded product so axially compresses a locally resilient band of the selected piston that the piston automatically flexes in radially outwardly loaded contour-conforming contact with the adjacent container inner-wall surface. Upon thereafter closing the product-loaded end of the container and providing a super-atmospheric charge of pressurized gas in the remaining volume within the piston, piston-seal contact is enhanced to prevent product seepage past the resilient band.

5 Claims, 7 Drawing Figures

METHOD OF MAKING A PRESSURE-OPERATED CONTAINER FOR VISCOUS PRODUCTS

This application is a division of my copending application, Ser. No. 616,363, filed Sept. 24, 1975, which copending application is a continuation-in-part of my original (but now abandoned) application, Ser. No. 459,328, filed Apr. 9, 1974, now abandoned.

The present invention relates to method aspects of a pressure-packaging system for viscous products.

Highly effective piston valve and container relationships of the character indicated are disclosed in my application Ser. No. 290,777 (now U.S. Pat. No. 3,827,607, issued Aug. 6, 1974). In said patent, the piston is characterized by a resilient flange member, spaced from the tubular body of the piston and responsive to pressure-loading, to maintain a light sealing pressure on the interior wall surface of the container. This construction, although effective, does present some complexity in the molding techniques needed to make each piston as a single integral product of plastic injection molding. Moreover, product-loading per se does not initially contribute to establishing a seal contact.

It is, accordingly, an object to provide an improved technique of the character indicated, lending itself to inherently simpler and less costly fabrication and to enhanced sealing effectiveness.

Another object is to achieve the above object with little or no sacrifice in operating effectiveness.

It is a specific object to provide an improved method for achieving smooth discharge flow in a container of the character indicated.

A specific object is to provide an improved method of making such a container wherein the act of product-loading against the head of the piston inherently causes the piston to develop an initial circumferentially continuous seal contact with the container wall.

A specific object is to achieve the foregoing objects in a valved pressure container having a piston operable therein in which the viscous product is in the valved end of the container and ahead of the piston while a gas, such as nitrogen, is introduced under pressure behind the piston to urge the latter against the product and expel the product through the valved opening.

Another specific object is to achieve the above objects in spite of any piston expansion, as may be caused by piston absorption of oils present in the viscous product to be dispensed.

A general object is to achieve the foregoing objects with a method which inherently simplifies container assembly, which permits the loaded container to operate smoothly and without piston bind even if the container has been so abused as to have side-wall indentations.

Other objects and various further features of novelty and invention will be pointed out or will occur to those skilled in the art from a reading of the following specification, in conjunction with the accompanying drawings. In said drawings.

Figure 1:
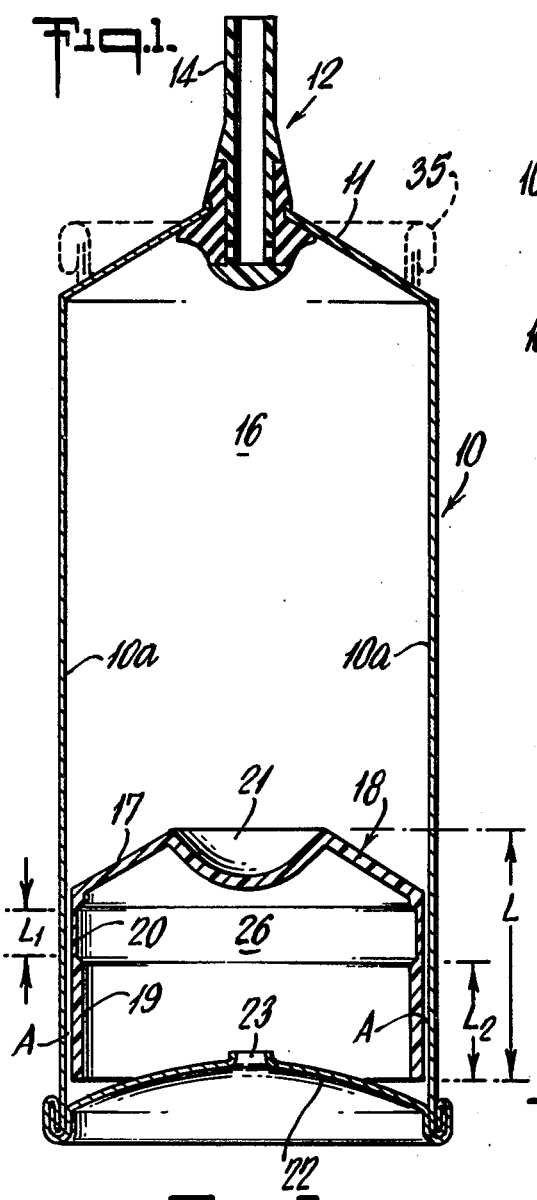
FIG. 1 is a longitudinal sectional view of a container of the invention, shown in unpressurized condition.
Figure 2:
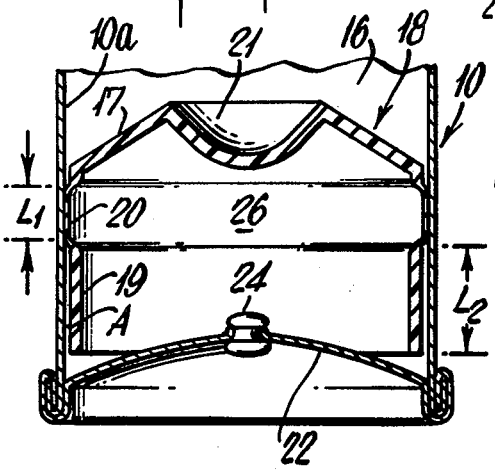
FIG. 2 is a fragmentary view similar to FIG. 1, to show a different parts relationship, under pressurized conditions.

Referring to FIGS. 1 and 2, a pressurized container or can 10 is formed with an integral concical top-end wall 11 and provided with a valve, referred to generally by the reference numeral 12. The valve 12 is of the variety in which a valve stem 14 is pressed laterally in a well-known manner in order to release the valve seal and permit the viscous product 16, which is at super-atmospheric pressure, to be expelled to the atmosphere. It is to be noted that the container and valve per se form no part of the present invention; however, particular cooperating relationships between these and other parts are regarded as inventive.

In accordance with a feature of the invention, a generally tubular hollow piston 18, which may be constituted of a low density polyethylene or a polypropylene material, is used to drive product 16 through the dispensing valve 12. Secured to or integral with upper and lower parts 17–19 is a relatively thin and resilient flexible circumferential band 20 of large external surface area and predetermined effective axial length $L_1$, for example 15 to 35 percent, of the overall axial extent L of piston 18. The upper part 17 is conical, in conformance with the conical shape of end wall 11, and is relatively thick and stiff, having a central generally spherical concavity 21 adapted for close fit to the generally convex spherical contour of the dispensing-valve member when product is fully dispensed, conical surfaces 11–17 being then in contact. The lower part 19 is cylindrical and may be viewed as a less flexibly yieldable second circumferential band of predetermined length $L_2$ near the open end of the piston. Generally, the thickness of the flexible band 20 is in the order of 0.005 and 0.015 inch and is less than one half the wall thickness of the less flexible band 19, and the more flexible length $L_1$ approximates but is preferably less than the less flexible length $L_2$.

Stated in other words as to flexibility, the nature and dimensions of the more flexible band 20 are such, in relation to the container wall surface **10*a*, that dependable but light sealing contact is provided with the container wall surface 10*a*, in the presence of propellant-gas pressure within piston 18. Also, under suchpressure, the nature and dimensions of the less flexible band 19 are such that no circumferentially continuous contact thereof is established with wall surface 10*a***.

The container 10 is closed by a bottom wall 22 having a central opening 23 for reception of a sealing grommet 24. Propellant gas 26, such as nitrogen, is introduced via opening 23 after viscous product 16 and piston 18 are inserted into the container, and grommet 24 completes the sealed closure under pressure. If the unstressed clearance A between piston band 20 and container wall **10*a* is small, e.g., zero to 0.010 inch, then rapid application of pressure-gas loading immediately inflates the flexible band into sealing contact with wall 10*a*, squeezing back into the product zone 16 any product which may have entered the clearance; thereafter, surface tension of the product, surface-wetting by the product of adjacent sealing surfaces 10*a*–20, and continued gas-pressure loading all combine to assure maintenance of a sealed relationship and therefore an effective non-contaminating isolation between the product chamber 16** and the gas chamber 26, through the life of the container, i.e., as long as product remains to be dispensed. At the same time, by reason of its less flexible property, the lower band 19 remains in clearance relation with wall 10*a*, as suggested at A in FIG. 2, so that the flexible band 20 is the only means of piston suspension in a loaded container.

FIG. 2 also serves to illustrate an embodiment in which, in unstressed condition, the circumferential extent of flexible band 20 is substantially equal to or slightly greater than the peripheral extent of the container wall surface 10*a*, thus establishing very light frictional contact of these parts upon assembly; of course, such circumferential contact is to the exclusion of circumferential contact by the lower and less flexible band 19, as suggested by clearance A, to denote the lesser circumferential extent of band 19.

It will be noted that the space A, which permits easy loading and operation of piston 18 in container 19, functions to provide room for lateral expansion of less flexible piston parts 17–19, especially when oily-type or flavored products are loaded in the container, the expansion of these parts being due to absorption of product oils. With such absorption and expansion, the more resilient band 20 readily adapts by further flattening (i.e., larger-area contact) with the container wall 10*a*; however, light sealing pressure continues to characterize its resilient contact, sealing propellant from product, while permitting piston 18 and product to move smoothly as product is dispensed by valve means 12; the nature of resilient band 20 is to flex in and out of any indentations and over any projecting or other imperfections that might be present on the interior wall surface 10*a*.

Figure 3:
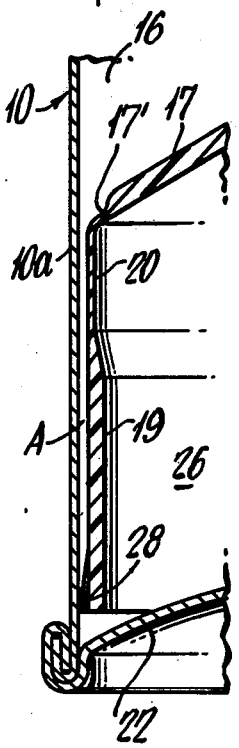
FIGS. 3 and 4 are enlarged fragmentary sectional views to show modifications.
Figure 4:
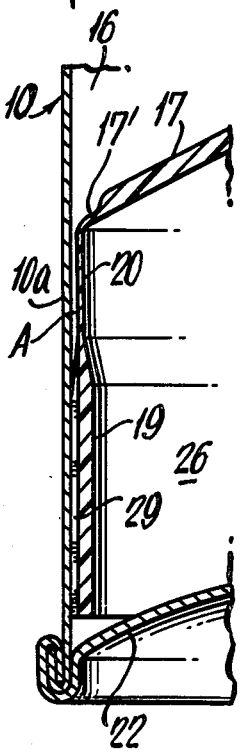

FIG. 3 shows a modification in which a plurality of angularly spaced longitudinally extending ribs or skids 28 are integrally formed in the outer wall of band 19, near the base end of the piston. As depicted, these skids are wedge-shaped, for non-fouling piston-stabilizing contact with the container wall. For a one-inch diameter piston, three or four of such equally spaced skids 28 are deemed adequate; for larger pistons greater numbers may be needed. FIG. 4 shows a further modification in which skids 29 ae provided as in FIG. 3 but of longitudinal extent approximating the length $L_2$ of the less flexible band 19. FIGS. 3 and 4 also illustrate a modified feature of relief at the corner 17', whereby the relatively thin band 20 effectively extends around the forward circular corner 17', thereby rendering piston contact with the container wall more softly flexible and hence, more readily adaptable to ride past bumps or other local discontinuities in the container wall.

Figure 5:
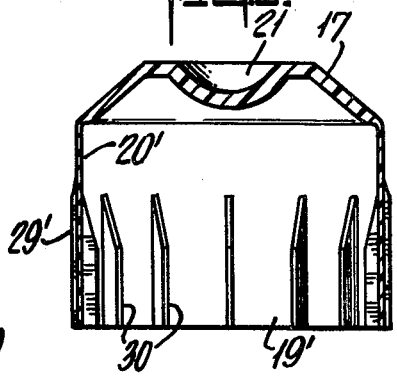
FIGS. 5 and 6 are respectively sectional and perspective views of a piston construction, representing further modification.
Figure 6:
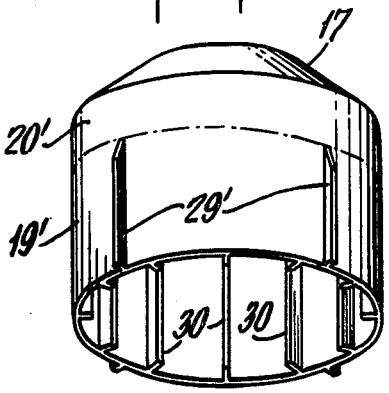

In the piston of FIGS. 5 and 6, a single relatively thin cylindrical wall thickness serves both the inflatable resilient band 20' and the less flexible band 19'. Band 19' is rendered less flexible by provision of a plurality of integral longitudinally elongate radially inward stiffening ribs 30, and is of course additionally stiffened by external skid formations 29', as described in connection with FIG. 4. Inflation, sealing, and stabilizing functions are as previously described.

The structure thus far described has involved a container 10 in which the top end wall is integral with the cylindrical body, all to enable bottom-filling of the inverted container body via its open bottom, prior to piston assembly, bottom closure and gas pressuring. The invention is also equally applicable in top-filling applications, wherein the bottom panel 22 is an integral part of the cylindrical body of the container and wherein the conical top-end panel 11 (with its valve means 12) is a separate subassembly, secured to the container body after piston insertion and product filling via the open top; separate connection of such a top-filled construction is suggested by a phantom outline of a chime connection at 35 in FIG. 1.

In top-filling applications of the invention, it will be appreciated that the weight of product loaded over the closed end 17 of the piston will first drive the piston skirt 19 into contact with the container bottom and will then so incrementally axially compress and radially outwardly urge the thin resilient band region 20 as to lightly radially outwardly load the same into assured circumferentially continuous sealing contact with the container wall. Such contact remains while the top end (with its valve 12) is chime-connected, to close the top end over the loaded product. And subsequent gas-pressurizing and sealing at 24 merely pressure-loads the band 20 to assure continued large-area contact with the container wall, throughout the dispensable-product life of the container.

Figure 7:
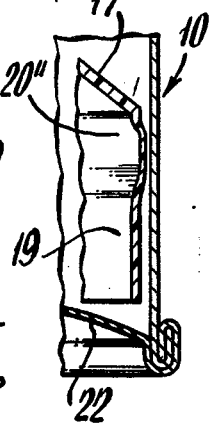
FIG. 7 is a fragmentary view similar to that at the lower right-hand portion of FIG. 1, to show further modification.

The modification of FIG. 7 will be recognized for its general similarity to FIG. 1, except that FIG. 7 is shown in the unstressed condition; and when pressure inflated the embodiment of FIG. 7 will present the appearance of FIG. 2, in relation to the container wall. Specifically, the piston of FIG. 7 comprises a first relatively thin and expandable flexible cylindrical band 20'' of unstressed external peripheral extent which exceeds the peripheral extent of the second band 19'', so that under pressurized conditions, the peripherally continuous light sealing contact with the container wall is definitely limited to the first band 20'', and the second band can be assuredly limited to stabilizing contact with the wall, i.e., less than peripherally continuous. Generally, I prefer that the difference in maximum external peripheral extents of band 20''–19'', in the unstressed state, shall be relatively small, as for example in the order of 0.005 to 0.010 inch for a 1.5-inch container-bore diameter. Also, generally speaking, for the polyethylene and polypropylene materials indicated as preferable, the typical design relation for the maximum unstressed peripheral extent of the first band 20'' is in the range of zero to 0.030-inch less than the bore periphery of the container wall.

The invention will be seen to have achieved all stated objects, with inherent simplicity and economy of parts, their assembly, and their construction. Wedge formations on stabilizing ribs 28–29 aid removability from the piston wall, and they also assure against any substantial circumferential arc of engagement of the lower end of the piston with the container wall.

While the invention has been described in detail for the preferred forms shown, it will be understood that modifications may be made without departure from the claimed invention.

What is claimed is:

1. The method of making a pressurized container for dispensing viscous material, which comprises selecting an open-top cylindrical container body and a top closure with a dispensing valve, selecting a cupped cylindrical piston body of diameter at least no greater than the container-bore diameter and with a relatively thin-walled flexible peripherally continuous and radially expandable tubular band integrally uniting and axially spacing the upper end of the piston from the downwardly extending remainder thereof, assembling the selected piston through the open top of the container with the closed end of the piston facing upwardly for contact with viscous products, radially expanding said band into relatively lightly loaded but circumferentially continuous contact with the container-wall surface by loading viscous product downwardly into the open end and in intimate void-free contact with container inner-wall surfaces and the upper end of the piston, assembling and sealing the selected top closure to the open end of the loaded container, and developing a super-atmospheric charge of pressurized gas in the remaining container volume within the piston, whereby piston-seal contact is enhanced to prevent product seepage past the flexible band.

2. The method of claim 1, in which the step of charging with pressurized gas is performed soon after the steps of product-loading and top closure.

3. The method of claim 1, in which the piston body is selected for a resilient seal band outer periphery which has a slight clearance relation with the inner-wall peripheral extent of the container, whereby the piston-insertion step is characterized by non-interfering descent within the container wall.

4. The method of claim 1, in which the piston body is selected for a resilient seal band outer periphery which is of unstressed outer peripheral extent exceeding that of the downwardly extending remainder of the piston, whereby product loading more readily radially outwardly loads the resilient band in its engagement with the container inner-wall surface.

5. The method of claim 4, in which the piston body is selected for a resilient seal band outer periphery which has a slight clearance relation with the inner-wall peripheral extent of the container, whereby the piston-insertion step is characterized by non-interfering descent within the container wall.

* * * * *